US005384980A

United States Patent [19]

Johnson et al.

[11] Patent Number: 5,384,980

[45] Date of Patent: Jan. 31, 1995

[54] GUN-AIMING DEVICE

[76] Inventors: Robert J. Johnson, 49588 McMahon Ck. Rd.; Jeff A. Johnson, Rte. 2, 70541 Maynard Rd., both of St. Clairsville, Ohio 43950

[21] Appl. No.: 33,486

[22] Filed: Mar. 18, 1993

[51] Int. Cl.[6] ..... F41G 1/02

[52] U.S. Cl. ..... 42/100; 33/243; 33/261

[58] Field of Search ..... 42/100; 33/233, 243, 33/261

[56] References Cited

U.S. PATENT DOCUMENTS

| | | | |
|---|---|---|---|
| 875,016 | 12/1907 | Uven et al. | 33/233 |
| 1,251,694 | 1/1918 | Randall | 33/233 |
| 1,365,236 | 1/1921 | Fletcher et al. | 42/100 |
| 1,852,875 | 4/1932 | Endrezze | 33/243 |
| 2,192,544 | 3/1940 | Fisk | 33/258 |
| 2,297,575 | 9/1942 | McLean | 33/243 |
| 4,006,531 | 2/1977 | Kwako | 33/261 |
| 4,008,536 | 2/1977 | Adams | 42/100 |
| 5,016,381 | 5/1991 | Ferraro | 42/100 |
| 5,016,382 | 5/1991 | Pickle | 42/100 |

FOREIGN PATENT DOCUMENTS

| | | | |
|---|---|---|---|
| 117845 | 9/1984 | European Pat. Off. | 33/243 |

*Primary Examiner*—Stephen M. Johnson
*Attorney, Agent, or Firm*—John R. Flanagan

[57] ABSTRACT

A gun-aiming device includes a base mount for attaching to a gun barrel having first and second orthogonally arranged passages, a sighting element having a stem portion with an annular groove and a head portion attached to one end of the stem portion with the stem portion removably mounted in the first passage of the base mount such that the head portion extends above the base mount for use in aiming the gun, and a yieldable biasing arrangement disposed in the second passage of the base mount for releasably engaging the annular groove of the stem portion of the sighting element at any location about the stem portion so as to provide a quick release snap-fit type of latching of the stem portion of the sighting element in the first passage of the base mount. A plurality of sighting elements being interchangeable with one another are provided. The sighting elements have respective head portions of different sizes and colors for respectively adapting the gun-aiming device to different distances and backgrounds.

26 Claims, 1 Drawing Sheet

GUN-AIMING DEVICE

BACKGROUND OF THE INVENTION

1. Field of the Invention

The present invention generally relates to hunting and trap shooting equipment and, more particularly, is concerned with a gun-aiming device.

2. Description of the Prior Art

Game hunting and trap shooting are widely popular activities practiced by thousands of sportsmen in the United States. For optimum results, the sportsman needs equipment which is readily adaptable to a variety of circumstances.

Specifically, for both game hunters and trap shooters, sighting aids are of obvious importance in obtaining maximum shooting efficiency, whatever the particular type of gun selected. Numerous sighting aids have been devised for attachment to a variety of gun types. Some of these include components which are attached on or built directly into the gun barrel itself.

One typical threaded sighting element is seen in FIG. 1. This sighting element, generally designated 10, has a head portion 12 attached to one end of a threadable stem portion 14. The stem portion 14 is mountable in the threaded upwardly opening passage 16 of the gun barrel 18. One drawback of this construction is that after repeated use the threads on the stem and barrel aperture will wear down or become stripped, thereby loosening up the gunsight device and diminishing its effectiveness in sighting a target.

Various non-threaded removable gunsight devices have been proposed to overcome the drawback of the prior art gunsight device of FIG. 1. Representative examples of these non-threaded removable gunsight devices are the ones disclosed in U.S. patents to Adams (U.S. Pat. No. 4,008,536), Ferraro (U.S. Pat. No. 5,016,381) and Pickle (U.S. Pat. No. 5,016,382). While these non-threaded gunsight devices overcome the drawback of the threaded gunsight, they substitute other drawbacks in its place. These drawbacks are overly complex constructions, too many parts with differently shaped and angled surfaces requiring machining to close tolerances and thus costly fabrication, and tedious procedures for installing and removing the sighting element of the gunsight devices. Further, a number of movements, both angular and rotational, are required to position the particular sighting element in place for aiming the gun and then for removal of the sighting elment from its seat. Obviously, such construction and assembly of components are rather complicated and costly.

Additionally, hunters often paint their sighting element, specifically the head portion, a particular color to assist them in certain weather conditions or for specific types of game. Generally, for differing weather or hunting conditions, with respect to the sighting element of FIG. 1 the hunter will paint the head portion a corresponding color rather than removing the sighting element itself and inserting a different prepainted element, because of the limited durability of the threaded passage 16. Also, this permanent type of sighting element provides for only one size of head portion for aiming the gun, precluding such variations in size as may be needed for variations in distance of game hunted.

Consequently, a need exists for a gun-aiming device of simple construction which provides for quick mounting and removal of a particular sighting element from its base mount and for choice in color and size of the most suitable sighting element for particular hunting or trap shooting conditions.

SUMMARY OF THE INVENTION

The present invention provides a gun-aiming device designed to satisfy the aforementioned needs by avoiding the drawbacks of the prior art without introducing other drawbacks. Instead, the gun-aiming device of the present invention provides expanded capabilities not available in the prior art gunsights.

One capability is the ease of use of the gun-aiming device which is brought about by the configuration of a sighting element and its mannner of mounting in a base mount employed by the device. The sighting element has an annular groove which allows it to be inserted into and withdrawn from a latched position in a vertical passage of the base mount by merely moving the sighting element along the direction of a longitudinal axis of the passage without first having to rotate the sighting element to any particular angular position about the axis of the passage. The sighting element can thus be quickly and securely mounted in and released from the vertical passage in the base mount through a snap-fit type of latching by a yieldable biasing means disposed in a longitudinal or horizontal passage of the base mount which intersects with the vertical passage.

Another capability is the adaptability of the gun-aiming device to different conditions which is brought about by the provision of a plurality of the sighting elements which are interchangeable with one another. The interchangeable sighting elements have respective head portions of different sizes for adapting the gun-aiming device to hunting game at different distances or ranges and head portions of different colors for adapting the gun-aiming device to different backgrounds or game colors.

Accordingly, the present invention is directed to a gun-aiming device which comprises: (a) a base mount for attaching to a gun barrel; (b) a sighting element for mounting on the base mount; and (c) yieldable biasing means for releasably retaining the sighting element on the base mount. The base mount has a tapered and grooved rear portion and a pair of first and second passages intersecting one another and preferably arranged in orthogonal relation to one another. The first passage preferably has a vertical orientation. The sighting element is received in the vertical passage. The second passage preferably has a longitudinal orientation extending generally parallel to the gun barrel. The yieldable biasing means is disposed in the longitudinal passage so as to releasably latch and securely position the sighting element for use in aiming the gun and to permit quick release and removal of the sighting element from the base mount.

Preferably, as mentioned earlier, a plurality of interchangeable sighting elements are provided. The interchangeable sighting elements have respective head portions of different sizes for adapting the gunsight device to hunting game at different distances or ranges and of different colors for adapting the gunsight device to different backgrounds or game colors. Thus, a given one of the sighting elements is chosen for its optimum suitability in color and size for particular hunting and weather conditions.

More particularly, each sighting element has a head portion attached to one end of a stem portion. The head portions of the different elements are provided in a plurality of different sizes and colors, whereas the size of the stem portions of the different elements remains constant irrespective of the size of the head portion attached to the stem portion. The stem portion seats in the vertical passage of the base mount such that the head portion, being the specific component used for aiming the gun, extends above the base mount. The stem portion is formed with an annular groove spaced from its opposite ends and extending circumferentially around it. The annular groove is concave-shaped in cross-section to snugly receive a complementarily-shaped leading end portion of the yieldable biasing means at any location around the stem portion.

The yieldable biasing means is disposed along the longitudinal passage and comprises a stationarily-positioned threaded element, such as a screw, threadably engaged within an outer threaded section of the longitudinal passage, a plunger element reciprocally movable within an inner threadless section of the longitudinal passage and having a tip end projectable within the vertical passage of the base mount, and a coil spring disposed in the longitudinal passage between the threaded element and plunger element.

To install the sighting element in the base mount simple finger pressure is exerted downwardly on the head portion, pushing the stem portion into the vertical passage against the tip end of the plunger element and forcing the plunger element to retract into the longitudinal passage against the coil spring backed by the stationarily-positioned threaded element. Retraction of the plunger element continues until the annular groove of the stem portion is located adjacent to the plunger element. The annular groove provides a space for the plunger element to be extended by the compressed coil spring back into the vertical passage and its tip end to seat into the groove so as to engage the stem portion of the sighting element in a snap-fit type of latching relation.

To release the stem portion of the sighting element from this latching relation with the plunger element, simple finger pressure is again applied to the head portion so as to pull upwardly and lift the stem portion, causing the stem portion below the annular groove to push against the plunger tip end and to force it to retract into the longitudinal passage against the coil spring backed by the stationarily-positioned threaded element. Retraction of the plunger element allows complete removal of the sighting element from the vertical passage of the base mount.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
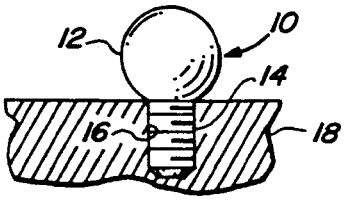
FIG. 1 (PRIOR ART)
FIG. 1 is a fragmentary sectional view of a prior art gunsight device which has been described in the background of the invention section hereinabove.

In the following description, like reference characters designate like or corresponding parts throughout the several views of the drawings. Also in the following description, it is to be understood that such terms as "top", "bottom", "front", "rear" and the like are words of convenience and are not to be construed as limiting terms.

Figure 2:
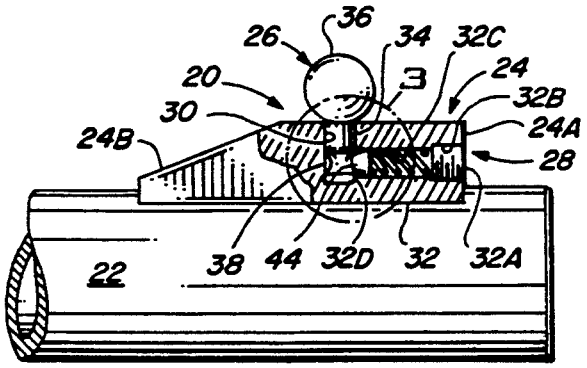
FIG. 2 is a side elevational view, partly sectioned, of the gun-aiming device of the invention, shown mounted on a gun barrel.
Figure 3:
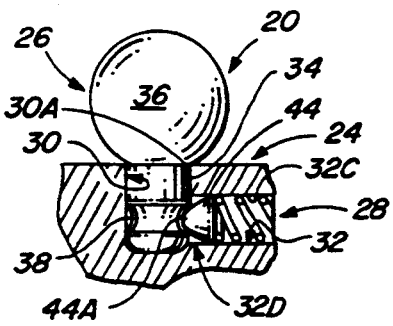
FIG. 3 is an enlarged fragmentary side elevational view, partly sectioned, of the portion enclosed by circle 3 in FIG. 2.
Figure 4:
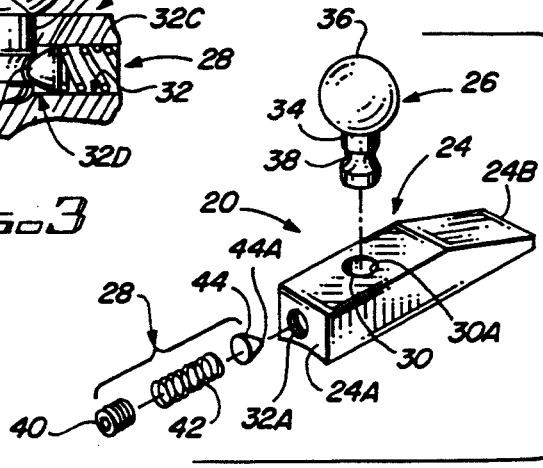
FIG. 4 is an exploded perspective view of the gun-aiming device of the invention.

Referring to the drawings and particularly to FIGS. 2–4, there is illustrated a gun-aiming device of the present invention, being generally designated 20, mounted on a gun barrel 22. In its basic components, the device 20 includes a base mount 24 for attaching to the gun barrel 22, a sighting element 26 for mounting on the base mount 24, and yieldable biasing means 28 for releasably retaining the sighting element 26 on the base mount 24.

The base mount 24 of the device 20 has first and second cylindrical passages 30, 32 intersecting one another and preferably orthogonally arranged with respect to each other. The first passage 30 extends vertically downward from an upward opening 30A on the top edge of the base mount 24. The second passage 32 extends horizontally or longitudinally along the direction of the gun barrel 22 from an outer opening 32A on the front face 24A of the base mount 24. The second passage 32 has an internally threaded forward or outer section 32B and a threadless rearward or inner section 32C which terminates in an inner opening 32D defined by an annular tapered edge having a smaller diameter than that of the rearward section 32C of the second passage 32. Also, the base mount 24 is tapered and grooved at its rear portion 24B so as to reduce sighting obstruction from light glare on the base mount 24.

The sighting element 26 of the device 20 has an elongated stem portion 34 of generally cylindrical shape and a head portion 36 of generally spherical shape attached to one end of the stem portion 34. The stem portion 34 is formed with an annular groove 38 spaced between the opposite ends thereof. The annular groove 38 has a concave shape in cross-section and extends circumferentially around the stem portion 34. With such configuration of the annular groove 38, the stem portion 34 is engageable at any location around it. The stem portion 34 is mountable in the first or vertical passage 30 of the base mount 24 such that the head portion 36 of the sighting element 26 extends above the base mount 24 for use in aiming the gun barrel 22.

The yieldable biasing means 28 of the device 20 is disposed along the second or longitudinal passage 32 of the base mount 24 and preferably includes a threaded element 40, such as a set screw, a compressible coil spring 42, and a plunger element 44. The threaded element 40 is threaded into the outer threaded section 32B of the longitudinal passage 32 through the outer opening 32A thereof to a stationary position where it is in engagement with one end of the coil spring 42. The plunger element 44 is reciprocally movable within the inner threadless section 32C of the longitudinal passage 32 and has a tip end 44A of convex cross-sectional shape complementary to the concave cross-sectional shape of the annular groove 38. The plunger tip end 44A is projectable or extendable from the longitudinal passage 32 through the inner opening 32D into the vertical passage 30 of the base mount 24 for seating into the annular groove 38 of the stem portion 34 of the sighting element 26. Of course, only the portion of the plunger tip end 44A smaller in cross-sectional size than the inner opening 32D can only project through the inner opening 32D. When the sighting element 26 is removed from the vertical passage 30, the plunger tip end 44A is prevented from being pushed by the coil spring 42 completely from the longitudinal passage 32 and into the vertical passage 30 by the reduced diameter annular tapered edge which defines the inner opening 32D. The compressible coil spring 42 is disposed in the longitudinal passage 32 between the threaded element 40 and plunger element 44 and exerts a force on the plunger element 44 which biases it for movement toward the vertical passage 30.

The sighting element 26 is easily installed through the upper opening 30A and in the vertical passage 30 of the base mount 24 by gripping the head portion 36 of the element 26 between the tips of one's thumb and index finger and pushing downwardly to force the stem portion 34 into a seated, latched position in the vertical passage 32, as shown in FIGS. 2 and 3. As the stem portion 34 is pushed downward toward the seated, latched position, the lower end of the stem portion 34 below the annular groove 38 first engages the tip end 44A of the plunger element 44 and forces it to retract away from the vertical passage 30 into the longitudinal passage 32 against the bias of the coil spring 42, causing the spring to compress against the threaded element 40. As the stem portion 34 is continued to be pushed downward toward the seated, latched position, the annular groove 38 is moved into a location adjacent to the plunger element 44, thus providing a space into which the tip end 44A of the plunger element 44 can be thrusted by the biasing force of the-coil spring 42. In such manner, a releasable latching relation is achieved between the plunger element 44 and the stem portion 34 of the sighting element 26 which retains the latter in the vertical passage 30 of the base mount 24.

Release of the sighting element 26 from the latching relation with the plunger element 44 and withdraw from the vertical passage 30 is achieved by substantially reversing the above-described procedure. The head portion 36 of the sighting element 26 is gripped between the tips of one's index finger and thumb and lifted upwardly to force the stem portion 34 from the seated, latched position in the vertical passaage 32 shown in FIGS. 2 and 3. The lower end of the stem portion 34 below the annular groove 38 first pushes against the tip end 44A of the plunger 44, forcing it to retract into the longitudinal passage 32 against the coil spring 42 and stationarily-positioned threaded element 40. The obstruction of the plunger 44 is thus removed, providing sufficient clearance in the vertical passage 30 to complete lifting of the stem portion 34 out of the vertical passage 30 of the base mount 24.

Figure 5:
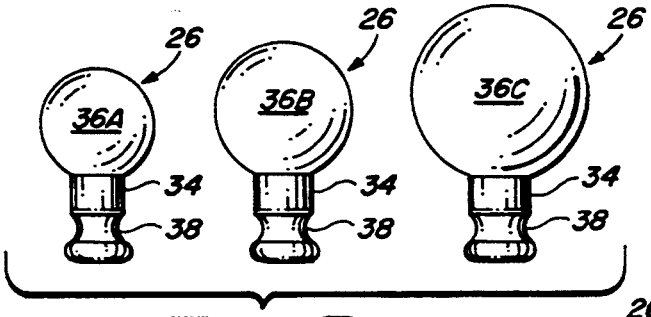
FIG. 5 is a side elevational view of different sizes of the head portion of the sighting element of the device.

Referring to FIG. 5, there is illustrated a plurality of interchangeable sighting elements 26. The diameter size of the stem portion 34 of the sighting elements 26, including the annular groove 38 thereof, remains constant, whereas the spherical head portion 36 has different diameter sizes, such as small 36A, medium 36B and large 36C, so that the optimum sighting element 26 for the size and distance of the game hunted can be selected.

Figure 6:
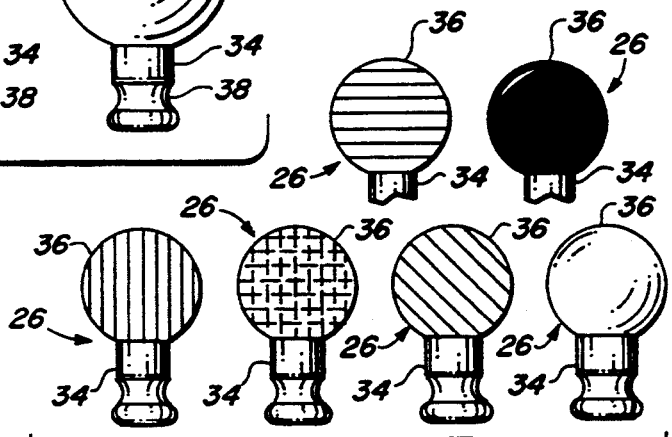
FIG. 6 is a side elevational view of different colors of the head portion of the sighting element of the device.

Similarly, referring to FIG. 6, the head portion 36 of the sighting element 26 can be provided in a variety of different colors, such as by way of example, blue, black, red, yellow, green and white. The different colors provide for selection of the color most suitable for the specific weather conditions and game color prevalent at the time of hunting.

The ease of quick mountability and removability of the sighting element 26 from and into the base mount 24 by exertion of simple finger pressure upward and downward, respectively, on the head portion 36 of the element 26 allows the hunter or trap shooter to change sighting elements as swiftly as hunting circumstances and weather conditions may dictate. In such manner, optimum sighting assistance in aiming the gun is attained.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

We claim:

1. A gun-aiming device, comprising:

(a) a base mount for attaching to a gun barrel, said base mount having first and second cylindrical passages arranged in an intersecting relation with one another, said first cylindrical passage having a longitudinal axis;

(b) a sighting element having a head portion and a stem portion, said head portion attached to one end of said stem portion, said stem portion having a cylindrical shape adapting said stem portion to fit within said first passage of said base mount with said cylindrical stem portion rotated to any angular position about said longitudinal axis of said first passage, said cylindrical stem portion including an annular groove being concave-shaped in cross-section and extending circumferentially about said cylindrical stem portion and being spaced between opposite ends of said cylindrical stem portion, said cylindrical stem portion being removably mounted in said first passage of said base mount such that said head portion extends above said base mount for use in aiming the gun; and (c) a yieldable biasing means disposed in said second passage of said base mount and extendable into said first passage so as to releasably engage said annular groove of said cylindrical stem portion of said sighting element at any circumferential location about said cylindrical stem portion so as to provide a quick release snap-fit type of latching of said cylindrical stem portion of said sighting element in said first passage of said base mount.

2. The device of claim 1 wherein said first and second passage are arranged in orthogonal relation to one another.

3. The device of claim 1 wherein said second passage extends in a generally longitudinal and parallel relation to the gun barrel.

4. The device of claim 1 wherein said second passage of said base mount is formed with an outer threaded section extending from an outer opening in a front edge of said base mount.

5. The device of claim 4 wherein said second passage of said base mount is formed with an inner threadless section extending from an inner opening communicating with said first passage of said base mount.

6. The device of claim 5 wherein said yieldable biasing means includes a threaded element threadably applied at a stationary position in said outer threaded section of said second passage.

7. The device of claim 6 wherein said yieldable biasing means also includes a plunger element slidably mounted in said inner threadless section of said second passage for reciprocal movement toward a latching position in which a tip end of said plunger element extends through said inner opening into said first passage and into engagement with said annular groove of said cylindrical stem portion of said sighting element and movement away from said latching position in which said tip end of said plunger element is retracted into said second passage from said first passage.

8. The device of claim 7 wherein said yieldable biasing means further includes a compressible spring disposed in said threadless section of said second passage between and in contact with said plunger element and said threaded element.

9. The device of claim 7 wherein said tip end of said plunger element has a portion smaller in cross-sectional size than said inner opening of said second passage such only said tip end portion can project through said inner opening into said first passage.

10. The device of claim 7 wherein said tip end of said plunger element has a convex cross-sectional shape complementary to and seatable in said concave cross-sectionally shaped groove.

11. A gun-aiming device, comprising:

(a) a base mount for attaching to a gun barrel, said base mount having first and second passages arranged in an intersecting relation with one another;

(b) a plurality of sighting elements having a head portion and a stem portion, said head portion attached to one end of said stem portion and being spherical in shape, said stem portion having an annular element extending about said stem portion, said stem portion being removably mounted in said first passage of said base mount such that said head portion extends above said base mount for use in aiming the gun, said sighting elements of said plurality being interchangeable with one another, said spherical head portions of said sighting elements being of different diameter sizes for respectively adapting to different distances, said stem portions of said sighting elements being of the same diameter size; and (c) a yieldable biasing means disposed in said second passage of said base mount and extendable into said first passage so as to releasably engage said annular element of said stem portion of said sighting element at any location about said stem portion so as to provide a quick release snap-fit type of latching of said stem portion of said sighting element in said first passage of said base mount.

12. The device of claim 11 wherein said first and second passage are arranged in orthogonal relation to one another.

13. The device of claim 11 wherein said second passage of said base mount is formed with an outer threaded section extending from an outer opening in a front edge of said base mount.

14. The device of claim 13 wherein said second passage of said base mount is formed with an inner threadless section extending from an inner opening communicating with said first passage of said base mount.

15. The device of claim 14 wherein said yieldable biasing means includes a threaded element threadably applied at a stationary position in said outer threaded section of said second passage.

16. The device of claim 15 wherein said yieldable biasing means also includes a plunger element slidably mounted in said inner threadless section of said second passage for reciprocal movement toward a latching position in which a tip end of said plunger element extends through said inner opening into said first passage and into engagement with said annular element of one of said sighting elements and movement away from said latching position in which said tip end of said plunger element is retracted into said second passage from said first passage.

17. The device of claim 16 wherein said yieldable biasing means further includes a compressible spring disposed in said threadless section of said second passage between and in contact with said plunger element and said threaded element.

18. The device of claim 16 wherein:

said annular element on said stem portion is a groove having a concave cross-sectional shape; and said tip end of said plunger element has a convex cross-sectional shape complementary to and seatable in said groove.

19. A gun-aiming device, comprising:

(a) a base mount for attaching to a gun barrel, said base mount having first and second passages arranged in an intersecting relation with one another;

(b) a plurality of sighting elements having a head portion and a stem portion, said head portion attached to one end of said stem portion and being spherical in shape, said stem portion having an annular element extending about said stem portion, said stem portion being removably mounted in said first passage of said base mount such that said head portion extends above said base mount for use in aiming the gun, said sighting elements of said plurality being interchangeable with one another, said spherical head portions of said sighting elements being of different colors for respectively adapting to different backgrounds and of different diameter sizes for respectively adapting to different distances, said stem portions of said sighting elements being of the same diameter size; and (c) a yieldable biasing means disposed in said second passage of said base mount and extendable into said first passage so as to releasably engage said annular element of said stem portion of said sighting element at any location about said stem portion so as to provide a quick release snap-fit type of latching of said stem portion of said sighting element in said first passage of said base mount.

20. The device of claim 19 wherein said first and second passage are arranged in orthogonal relation to one another.

21. The device of claim 19 wherein said second passage of said base mount is formed with an outer threaded section extending from an outer opening in a front edge of said base mount.

22. The device of claim 21 wherein said second passage of said base mount is formed with an inner threadless section extending from an inner opening communicating with said first passage of said base mount.

23. The device of claim 22 wherein said yieldable biasing means includes a threaded element threadably applied at a stationary position in said outer threaded section of said second passage.

24. The device of claim 23 wherein said yieldable biasing means also includes a plunger element slidably mounted in said inner threadless section of said second passage for reciprocal movement toward a latching position in which a tip end of said plunger element extends through said inner opening into said first passage and into engagement with said annular element of one of said sighting elements and movement away from said latching position in which said tip end of said plunger element is retracted into said second passage from said first passage.

25. The device of claim 24 wherein said yieldable biasing means further includes a compressible spring disposed in said threadless section of said second passage between and in contact with said plunger element and said threaded element.

26. The device of claim 19 wherein:

said annular element on said stem portion is a groove having a concave cross-sectional shape; and said tip end of said plunger element has a convex cross-sectional shape complementary to and seatable in said groove.

* * * * *